United States Patent [19]

Agarwala

[11] Patent Number: 4,920,326

[45] Date of Patent: Apr. 24, 1990

[54] METHOD OF MAGNETIZING HIGH ENERGY RARE EARTH ALLOY MAGNETS

[75] Inventor: Ashok K. Agarwala, Penfield, N.Y.

[73] Assignee: Eastman Kodak Company, Rochester, N.Y.

[21] Appl. No.: 301,687

[22] Filed: Jan. 26, 1989

[51] Int. Cl.[5] ..... H01F 13/00

[52] U.S. Cl. ..... 335/284; 148/103; 148/108

[58] Field of Search ..... 335/284; 148/103, 108, 148/121

[56] References Cited

U.S. PATENT DOCUMENTS

| | | | |
|---|---|---|---|
| 4,093,477 | 6/1978 | Iwata et al. | 148/108 |
| 4,156,623 | 5/1979 | Becker | 148/103 |
| 4,246,049 | 1/1981 | Bronner et al. | 148/103 |
| 4,305,764 | 12/1981 | Iwata | 148/103 |
| 4,533,408 | 8/1985 | Koon | 148/103 |
| 4,544,421 | 10/1985 | Springer | 148/103 |

OTHER PUBLICATIONS

"Magnetizability of Nd-Fe-B-Type Magnets with Dy Additions", M. Tokunaga, M. Endoh, H. Harada and S. R. Trout, *J. Appl. Phys.,* 63(8), Apr. 15, 1988, pp. 3510-3512.

*Primary Examiner*—George Harris
*Attorney, Agent, or Firm*—Robert A. Gerlach

[57] ABSTRACT

A method of magnetizing high energy rare earth alloy magnets by applying a magnetic field while heating the magnetic alloy.

6 Claims, 2 Drawing Sheets

METHOD OF MAGNETIZING HIGH ENERGY RARE EARTH ALLOY MAGNETS

BACKGROUND OF THE INVENTION

Field of the Invention

This invention relates to a method of magnetizing high energy rare earth alloy magnets, and more particularly to a method of imparting to a magnetic alloy basic sophisticated pattern of north and south poles:

High energy rare earth alloy magnetic materials requires a high magnetizing field strength to charge the materials to saturation. A long established "rule of thumb" is that the field strength required for saturation is five to six times the value of the intrinsic coercive force (Hci). Thus, with high energy, modern day magnetic materials, charging fields of 40 to 100 kiloOersteds would not be uncommon to insure saturation. From both a technical and economical view point, this is a great concern to magnet manufacturers and magnet users. Many times, the users will purchase magnetic materials from the alloy manufacturers and either machine or have the alloy blanks machined into the desired shape to suit the ultimate purpose. To facilitate handling during shipping and machining, the magnetic alloy material should be in the demagnetized state during these times. In fact, it is most desirable that the magnetic alloy be magnetized after assembly into the device in which it is employed. For example, in the manufacture of a D.C. brushless motor, the magnetic component having the predesigned shape to precisely fit in the motor is first assembled and then magnetized. This is not always practical because of the configuration of the device, which either prevents the proximate location of the magnetization coil or other magnetization device or serves as a flux shunt thereby directing the charging field away from the magnet.

Further, the user who generally charges the magnet material, does not always possess the equipment capable of developing sufficient high fields to saturate these high energy magnets. For example, a mild steel core electromagnet will generate a maximum field of about 24 kOe. Therefore, should a larger field be required to charge a high energy rare earth alloy magnetic material, a different device must be employed.

Where very high fields are necessary, to charge high energy magnets, impulse magnetizers are employed. While these devices develop instantaneous fields sufficiently large to substantially fully saturate all known permanent magnet materials, they may not be technically feasible for use where a magnet is required to have tiny multiple poles (such as an application for a small stepping motor) or complex pole patterns. This is due to the practical limitation to the amount of required current that can be passed through the small electromagnetic coils employed in the charging process without damaging the coils.

Therefore, there is a definite need to provide a way to saturate high energy rare earth magnetic materials at the lowest possible field strength. Also, there is a need to magnetize high energy rare earth magnetic materials in a discrete pattern of north and south poles.

SUMMARY OF THE INVENTION

The invention provides a method of fully saturating a high energy, rare-earth permanent magnet material by subjecting the magnet material to a charging field while at a temperature at least 10° C. above room temperature. By this technique, it has been found that the magnet can be saturated at a field strength much lower than that necessary at room temperature.

Thus, in accordance with this invention, the magnetic rare earth alloy can be prepared by any suitable technique known in the art, machined into the desired shape to serve in its ultimate utility and finally magnetized to saturation either after installation into the device or just prior to being installed into the device.

If the magnetic material is to contain a multiple pole pattern in discrete areas, a suitable charging device having a coil pattern corresponding to the desired pole pattern is positioned proximal to the heated magnetic material. A pulse current having the proper current direction is passed through each coil and the desired north and south pole pattern is imparted.

DESCRIPTION OF THE PREFERRED EMBODIMENTS

Figure 1:
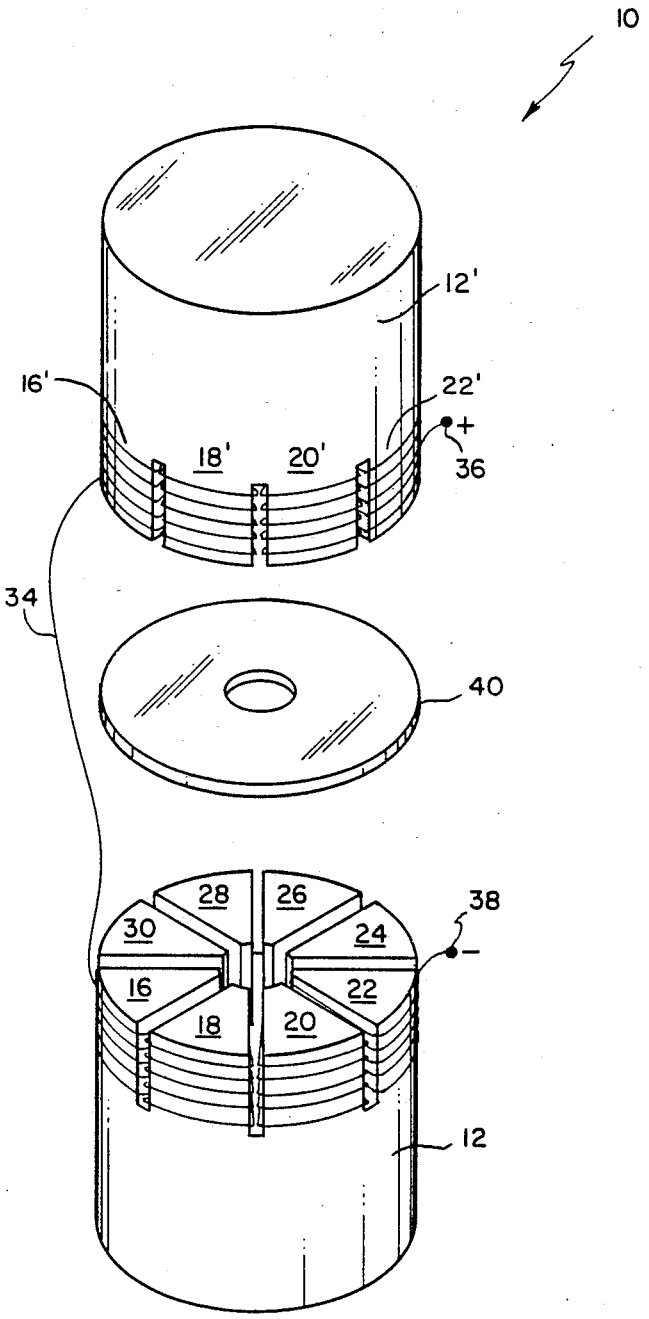
FIG. 1 is a perspective view of a device suitable for imparting a multiple pole pattern to a magnet.

It has been discovered that the problem involved with charging high energy magnets can be alleviated by prior to imparting a charging field to the magnetic alloy, while maintaining the alloy at least 10° C. above room temperature, but below the Curie temperature of the material being charged. Preferably, the material being charged is heated at a temperature of from about 50° C. to a temperature less than one-half the Curie temperature of the rare earth alloy material being charged and most preferably less than 150° C. By employing this technique, it has been discovered that regardless of the minimum charging field employed to completely saturate a rare earth alloy magnetic material at room temperature, the amplitude of the charging field can be reduced by first heating the alloy material above room temperature in accordance with this invention. By practicing the method of this invention, high energy rare earth alloy magnets can be completely saturated utilizing devices that would be incapable of saturating the particular rare earth alloy magnetic material at room temperature. Further, complicated multiple pole patterns can be devised and arranged within the magnetic alloy material in close proximity to each other because of the lower fields employed.

The practice of this invention is applicable to the saturation of any suitable rare earth alloy magnet such as, for example, those containing samarium, cerium, praseodymium, neodymium, lanthanum, terbium and the like. The rare earth may be alloyed with a transition metal such as, for example, iron, cobalt, manganese, chromium, nickel and the like. Iron is the preferred transition metal because of the properties imparted to the magnetic material and also because of its abundance. Other suitable elements for preparation of rare earth permanent magnet alloys include boron, aluminum, molybdenum, tungsten, tantalum, niobium, hafnium, tin, bismuth, and the like. Samarium cobalt is a well-known high energy permanent magnet material suitable for use in the practice of this invention. A preferred class of materials for use herein are the permanent magnet alloys of neodymium-iron-boron because of their high energy product and also because of the relative abundance of the materials from which they are formed.

Any suitable method of manufacturing the alloy materials in accordance with this invention may be employed such as, for example, sintering, melt spinning together with annealing, hot pressing and die upsetting procedural steps, and also bonded magnets wherein the alloy powder is incorporated in a binding agent such as epoxy resin and the like.

In the process in accordance with this invention, the high energy rare earth alloy permanent magnet material or portions thereof (should a north and south pole pattern be imparted to the material) is exposed to a sufficiently high amplitude magnetic field. To accomplish this, a RFL 595 Magnetcharger Unit sold by RFL Industries, Inc. of Boonton, N.J., which is capable of producing a magnetic field pulse up to 100 kOe amplitude can be used. This device employs an air-core solenoid for magnetizing the rare earth permanent magnet material. This magnetizer creates a high current pulse by discharging via an ignitron tube a large amount of electric charge accumulated in a bank of capacitors. This current passes through the solenoid of the charging fixture producing a pulse of high magnetic field which thereby magnetizes the sample placed inside the solenoid. A type-E thermocouple junction is disposed within the solenoid, for contact with the magnetic material to be saturated in order to measure the temperature thereof. In order to ensure uniformity in results the samples to be magnetized in accordance with this invention should first be demagnetized. This can be achieved by either treating the magnet to a slowly oscillating field (provided by an electromagnet) of decreasing magnitude until a remanence value close to zero is obtained. This process is referred to as demagnetization at room temperature. It is also possible to thermally demagnetize a magnetic material by heating above the Curie point and allowing it to cool back to room temperature in zero field. With materials having a very high Curie point it is sometimes undesirable to thermally demagnetize because irreparable damage may occur owing to changes that may take place in the microstructure of the magnetic material at high temperatures.

While the magnetic material may be heated while in position within this solenoid or in position with regard to any suitable charging device, it is preferred from a practical standpoint to heat the magnetic material externally in an oven or other suitable apparatus and then physically transfer the magnetic material to the charging unit. While positioned within the charging unit, the temperature of the material is monitored by means of the thermocouple attached thereto and at the appropriate temperature the magnetizing field pulse from the magnet charger is applied.

The degree of saturation for any given sample of a rare earth permanent magnetic alloy material is determined by the properties which are exhibited by the demagnetization curve in the second quadrant of the hysteresis loop. These properties are determined by a HG-105 Hysteresisgraph supplied by KJS Associates of Dayton, Ohio. For practical purposes a material is saturated by a given field when applying a larger field does not change the properties exhibited in the second quadrant. For purposes of this invention, saturation is defined as a value within 95% of the potential value when measured by the second quadrant properties.

The HG-105 Hysteresisgraph used to obtain the demagnetization curves has a flat probe approximately 4.2 millimeters thick with a square hole one centimeter on the side wherein the sample to be tested is inserted. Within the probe and around the sample are two sets of coils. One measures (B-H) of $4\pi M$ and the other measure H. A sample in the form of a one centimeter cube is inserted in the square hole of the flat probe. The sample, which protrudes out of both sides of the probe, is sandwiched between the pole pieces of an electromagnet, such as, a Bruker Instruments Model BE-15 having six inch diameter poles and a variable pole gap. A pair of two inch tapered pole caps are attached to further enhance the field. Power to the electromagnet is supplied by a Bruker Instruments 45 ampere bipolar power supply. In this configuration the sample is in a closed magnetic circuit which eliminates the need to correct for a demagnetizing field. To obtain the second quadrant part of the hysteresis curve, the magnetic field from the electromagnet is applied in a direction opposite to the magnetization direction of the premagnetized sample. The field starting from zero at which the remanence is obtained, is slowly increased in magnitude until the output (B-H) of the hysteresis graph reads zero. The value of the applied field at this point corresponds to the intrinsic coercivity (Hci) of the sample. The signal output from the Hysteresisgraph in analog form is plotted as (B-H) versus H on a Hewlett Packard Model 7035B XY Recorder.

Referring specifically to FIG. 1, a magnetizing device 10 is shown having lower non-magnetic section 12 and upper non-magnetic section 12'. In the device depicted, lower section 12 is divided into eight pie shaped sections 16, 18, 20, 22, 24, 26, 28 and 30 and upper section 12' is divided into eight corresponding pie shaped sections 16', 18', 20', 22' as shown and 24', 26', 28' and 30' not shown. A continuous electrical conductor 34 is wound around each sector of each section such that alternate sectors of each section are wound in the opposite direction. For example, section 16 is wound clockwise, 18 counter-clockwise, 20 clockwise, etc. The conductor 34 is also wound such that the opposing sectors, 16 and 16' are wound in the same direction. The two ends of the continuous conductor 34 form positive terminal 36 and negative terminal 38 which can be connected to a suitable magnet charging device, such as, an RFL 595 Magnetcharger, previously described, in place of the solenoid usually employed therewith.

A pre-heated magnet 40 is placed between sections 12 and 12' and the pulse from the magnetcharger is passed through conductor 34. This pulse charges the magnet with alternating north and south pole in accordance with the configuration of sections 16 through 30'.

EXAMPLE I

Figure 2:
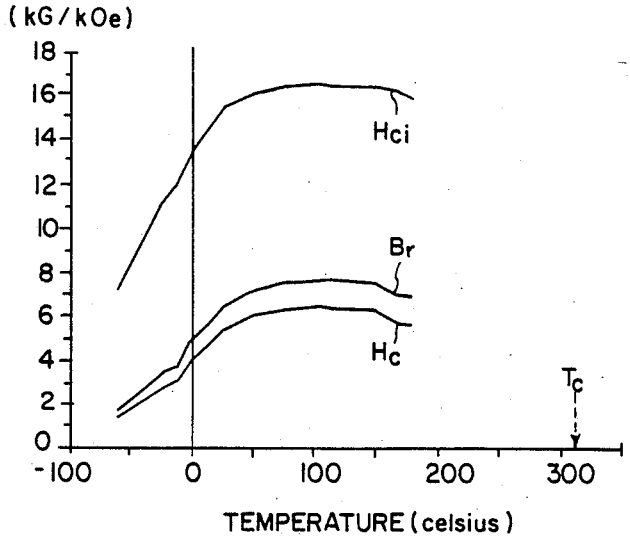
FIG. 2 is a graph plotting Br, Hc, and Hci against temperature at which an isotropic neodymium-iron-boron alloy is charged with a 22.8 kOe amplitude pulse.

FIG. 2 is a plot of remanence (Br) coercivity (Hc) and intrinsic coercivity (Hci) versus temperature at which magnetization is conducted in accordance with the above description for an isotropic neodymium-iron-boron alloy high energy permanent magnet material sold by General Motors Corp. under the trade designation MQII. This material is produced by rapidly quenching a neodymium-iron-boron alloy on a rapidly spinning quench wheel to obtain a crystallite grain size of 20 to 400 nanometers. The charging field pulse of the RFL 595 magnetcharger unit had an amplitude of 22.8 kOe. From FIG. 2 it is observed that Br, Hc and Hci achieve their maximum values for the charging performed in the range of from about 50° C. to about 150° C.

Figure 3:
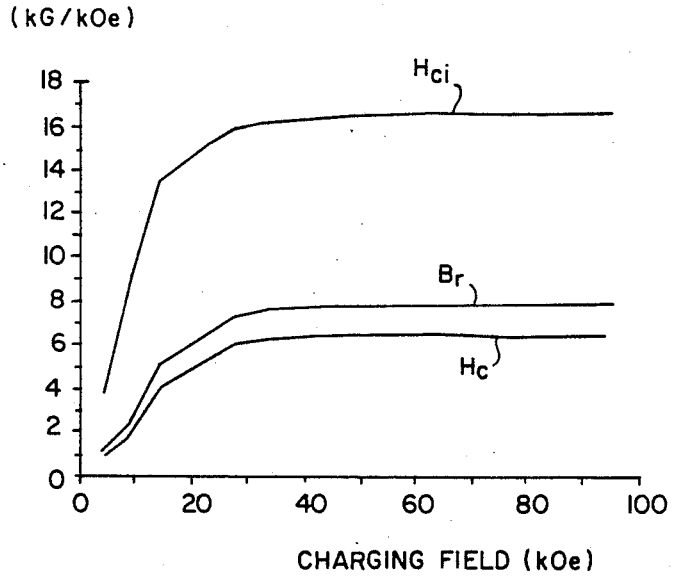
FIG. 3 is a plot of Br, Hc and Hci versus charging field amplitude at room temperature.

FIG. 3 is a plot of the same magnetic parameters versus the charging field amplitude for the same sample, after demagnetization charged at room temperature (22° C.). This graph indicates that in order to achieve the same second quadrant property values as that shown in FIG. 2, a charging field of about 42 kOe is required. Thus, by charging the sample at an elevated temperature in the range mentioned above, the amplitude of the charging field required to fully magnetize the sample is greatly reduced. Lower charging fields than the 22.8 kOe used may be employed to achieve saturation.

EXAMPLE II

The second quadrant property values of another magnetic material having the trade designation MQIII by General Motors Corporation were determined in a manner similar to Example I. This material is made in a fashion similar to that employed in Example I except that it is subsequent die upset by compression to impart anisotropy to the material. By charging a sample of this material at 22.8 kOe it was determined that saturation occurs between about 90° C. and 110° C. At room temperature, a charging field having an amplitude of 40 kOe is necessary to achieve saturation.

EXAMPLE III

A sintered and aligned neodymium-iron-boron permanent magnet material sold by Sumitomo Special Metals Co., Ltd. under the trade designation Neomax 35 was magnetized at room temperature (22° C.) using the previously described magnetcharger device at an amplitude of 22.8 kOe. The magnet was substantially saturated at this field demonstrating second quadrant properties as follows:

Br—11.5 kG
Hc—10.8 kOe
Hci—13.4 kOe

The same sample, after being demagnetized was magnetized at 13.9 kOe at 60° C. and demonstrates the following second quadrant properties:

Br—11.6 kG
Hc—10.2 kOe
Hci—13.2 kOe

EXAMPLE IV

A sintered and aligned samarium cobalt magnet sold under the trade designation Hicorex by Hitachi Magnetics Corp. was magnetized at room temperature in a field having an amplitude of 13.9 kOe and demonstrated the following second quadrant properties:

Br—8.8 kG
Hc—7.4 kOe
Hci—9.4 kOe

The same sample after being demagnetized was remagnetized at 13.9 kOe at 110° C. and demonstrated the following properties:

Br—9.7 kG
Hc—7.15 ke
Hci—9.8 kOe

The above examples clearly demonstrate that high energy rare earth alloy permanent magnet materials can be saturated using lower amplitude fields by conducting the magnetization at temperatures above room temperature.

It is to be understood that other high energy rare earth magnetic materials may be used in place of those used in these examples to achieve similar results.

What is claimed is:

1. A method of magnetizing high energy rare earth alloy magnets to saturation which comprises, subsequent to formation of the alloy, heating to a temperature at least 10° C. above room temperature to less than one-half the curie temperature and applying a magnetizing charging field less than 24 KiloOersteds.

2. The method of claim 1 wherein the rare earth alloy is heated to a temperature of from about 50° C. to about 150° C.

3. The method of claim 1 wherein the applied field is from 5 to 24 kOe.

4. The method of claim 1 wherein the rare earth alloy comprises neodymium, iron and boron.

5. The method of claim 1 wherein the magnet being charged is isotropic.

6. The method of claim 1 wherein a distinct multiple pattern of north and sourth poles are imparted to the magnet.

* * * * *